US009865931B1

(12) United States Patent
Tonn et al.

(10) Patent No.: US 9,865,931 B1
(45) Date of Patent: Jan. 9, 2018

(54) BROADBAND CYLINDRICAL ANTENNA AND METHOD

(71) Applicants: David A Tonn, Charlestown, RI (US); Susan M Safford, Jamestown, RI (US)

(72) Inventors: David A Tonn, Charlestown, RI (US); Susan M Safford, Jamestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 63 days.

(21) Appl. No.: 15/220,692

(22) Filed: Jul. 27, 2016

(51) Int. Cl.

| | |
|---|---|
| ***H01Q 13/18*** | (2006.01) |
| ***H01Q 13/22*** | (2006.01) |
| ***H01Q 1/48*** | (2006.01) |
| ***H01Q 1/50*** | (2006.01) |

(52) U.S. Cl.
CPC ..... *H01Q 13/22* (2013.01); *H01Q 1/48* (2013.01); *H01Q 1/50* (2013.01)

(58) Field of Classification Search
CPC ..... H01Q 13/10; H01Q 13/085; H01Q 1/48; H01Q 13/18; H01Q 21/0062; H01Q 1/50; H01Q 13/22
See application file for complete search history.

(56) References Cited

U.S. PATENT DOCUMENTS

| | | | | | |
|---|---|---|---|---|---|
| 2,433,368 | A * | 12/1947 | Johnson | H01Q 13/22 | 333/237 |
| 2,508,085 | A * | 5/1950 | Alford | H01Q 13/18 | 343/769 |
| 2,555,443 | A * | 6/1951 | Harvey | H01Q 13/10 | 333/33 |
| 2,993,205 | A * | 7/1961 | Cooper | H01Q 13/28 | 333/240 |
| 6,127,983 | A * | 10/2000 | Rivera | H01Q 1/30 | 343/709 |
| 6,636,183 | B1 * | 10/2003 | Hellgren | H01Q 1/1271 | 343/711 |
| 6,693,600 | B1 * | 2/2004 | Elliot | H01Q 1/27 | 343/715 |

* cited by examiner

*Primary Examiner* — Tho G Phan
(74) *Attorney, Agent, or Firm* — James M. Kasischke; Michael P. Stanley

(57) ABSTRACT

An antenna capable of being joined to an antenna feed and being positioned perpendicular to a ground plane includes a conductive cylinder having a longitudinal slot. The antenna feed is connected across the slot. A plurality of dielectric rods are provided parallel to the slot with rod being positioned much less than one wavelength of the maximum operating frequency away from adjacent rods. The rods each have a length of at least 25 times its mean diameter is made from a material having a dielectric constant greater than 30. The combination of the conductive cylinder and dielectric rods provides increased bandwidth. A kit for modifying existing antennas is further provided.

16 Claims, 6 Drawing Sheets

BROADBAND CYLINDRICAL ANTENNA AND METHOD

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to a cylindrical antenna having a broader bandwidth and a method for making such an antenna.

(2) Description of the Prior Art

Slotted cylinder antennas have been proposed in submarine applications before. For example, in U.S. Pat. No. 6,127,983, Rivera and Josypenko disclose a horizontally mounted slotted cylinder antenna for use in a towed buoy. Though somewhat broadband in performance, it is not suitable for vertical mounting over a groundplane. Removed from floating at the ocean's surface, the antenna becomes resonant and has a narrow bandwidth.

Slotted cylinder antennas are popular antennas for use in line of sight communications systems, especially where the carrier frequency exceeds 300 MHz. FIG. 1 provides a diagram of a prior art slotted cylinder antenna 10. Antenna 10 includes a metallic cylinder 12 having slot 14 cut into the wall of the cylinder 12. Cylinder 12 can be any thickness as long as skin effects are avoided. Slot 14 is parallel to an axis 16 of cylinder 12. Axis 16 is perpendicular to a ground plane 18. In the antenna shown, slot 14 extends the entire length of the cylinder 12. The interior of the cylinder or cavity is typically filled with air, but another dielectric material can be used.

FIG. 1 shows an end-fed version of this antenna, but this antenna can also be center-fed. In the end-fed version, a transmission line having a first conductor 20 is provided through the ground plane 18 and connected across the slot 14 near one end of the slot 14. A second conductor 22 is shown grounded to the ground plane 18. Transmission line can be either a balanced line, such as a twisted pair, or an unbalanced line, such as a length of coaxial line (shown). In either case, the feeding transmission line 18 must have two conductors in order to connect across slot 14. The optimal frequency of this antenna 10 is given by the length of the slot 14. The size of the cavity and the slot width govern bandwidth.

The dimensions of the antenna 10 components are critical to operating frequencies. Metallic cylinder 12 is typically made of copper and has an inner radius a, a thickness d and a height $h_1$. Cylinder 12 is raised above the ground plane 18 by a distance $h_2$ so that it is not in contact with the ground plane. Slot 14 has a width w. Slot 14 is cut so that it extends the entire length of cylinder 12. Slot 14 is parallel to axis 16.

In this embodiment, antenna 10 is fed by a coaxial feed arrangement that penetrates the ground plane 18 beneath the antenna 10. Outer conductor 22 of the coaxial feed is connected to ground plane 18 and to the bottom of cylinder 12 on the right hand side of slot 14. Center conductor 20 of the coaxial feed is connected to the bottom of cylinder 12 on the left hand side of slot 14. The coaxial feed is designed to have a standard 50 Ohm characteristic impedance.

FIG. 2 shows a computed voltage standing wave ratio (VSWR) for this antenna. The VSWR is a figure of merit used in determining the impedance bandwidth of the antenna. Typically, this bandwidth is defined as the continuous range of frequencies for which VSWR<3:1. The passband of the antenna is indicated at 26. For the example shown in FIG. 2, resonant character of the antenna can be seen in the oscillatory nature of the VSWR curve, and modest bandwidth in each passband.

SUMMARY OF THE INVENTION

It is a first object of the present invention to provide a vertically deployable antenna.

Another object is to provide such an antenna with greater bandwidth.

Yet another object is to provide an ability to modify preexisting slotted cylindrical antennas in order to enhance the bandwidth.

Accordingly, there is provided an antenna capable of being joined to an antenna feed and being positioned perpendicular to a ground plane includes a conductive cylinder having a longitudinal slot. The antenna feed is connected across the slot. A plurality of dielectric rods are provided parallel to the slot with rod being positioned much less than one wavelength of the maximum operating frequency away from adjacent rods. The rods each have a length of at least 25 times its mean diameter is made from a material having a dielectric constant greater than 30. The combination of the conductive cylinder and dielectric rods provides increased bandwidth. A kit for modifying existing antennas is further provided.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 3:
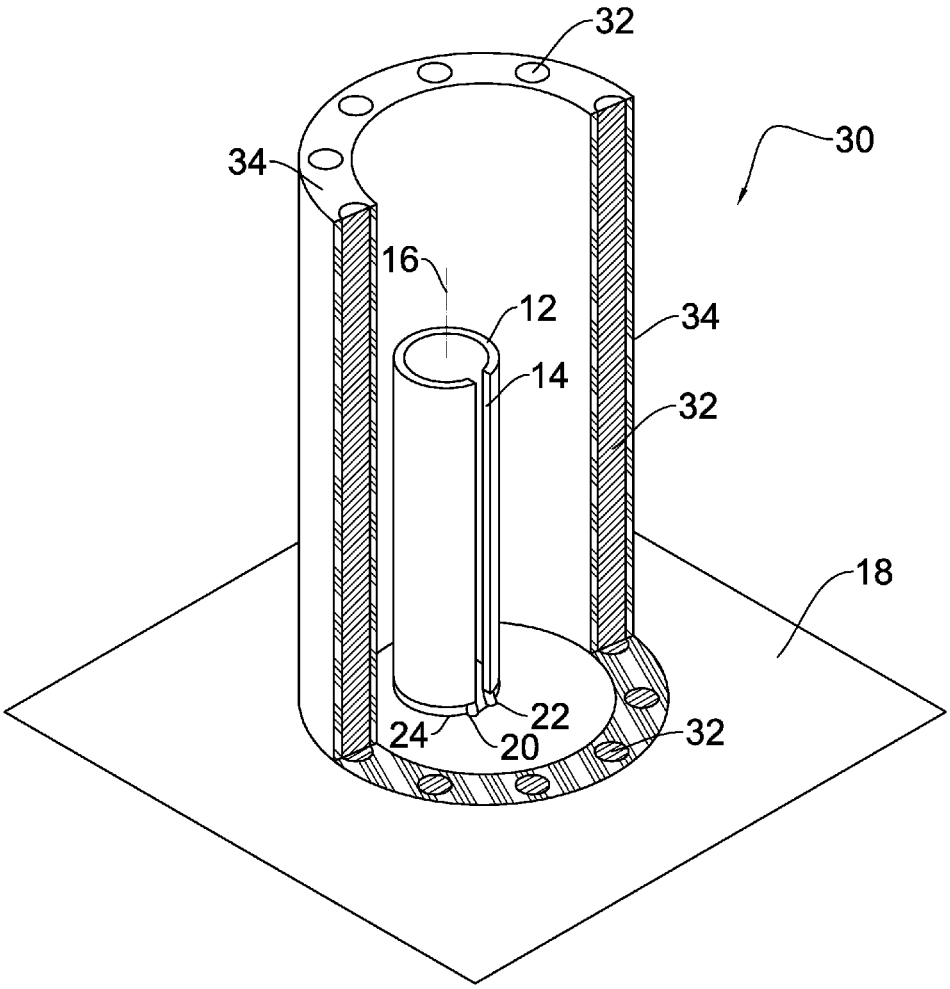
FIG. 3 is a partially cut-away perspective view of one embodiment of an antenna.

In FIG. 3, there is shown an embodiment of an antenna 30. Antenna 30 includes a slotted cylinder 12 having a slot 14 formed longitudinally therein. Slot 14 is parallel with an axis 16. Slotted cylinder 12 is perpendicular to ground plane 18. Slotted cylinder is end fed by a two conductor feed including a first conductor 20 and a second conductor 22. First conductor 20 is joined to slotted cylinder 12 at a first side of slot 14. Second conductor 22 is joined to slotted cylinder 12 at a second side of slot 14 opposite the first side. An insulator 24 is provided between slotted cylinder 12 and ground plane 18. A plurality of dielectric rods 32 are provided outside slotted cylinder 12. Rods 32 are arranged radially and regularly spaced around slot 14 with the axis of each rod 32 being parallel to slot 14. In the tested embodiment, ten rods 32 were utilized, but more or fewer rods 32 could be utilized. The number of rods is selected so that the spacing between the rods is much smaller than the shortest wavelength of operation; however, spacing between rods 32 is not critical as long as the spacing is much smaller than the shortest wavelength. Spacing between the rods was about 2.4% of the wavelength at the highest frequency in the tested embodiment. It is believed that this spacing could be as much as 5% of the wavelength at the highest frequency or as little as 1% while still maintaining this broadening effect. The spacing between the rods should also be at least the diameter of one of the rods. This avoids the rods acting as a solid cylinder of material. The rods should extend around the entire slotted cylinder 12 to interact with all of the near field energy produced by the slotted cylinder 12. This means that the rods 32 should extend beyond the maximum and minimum vertical extents of cylinder 12. A cylindrical rod holder 34 has a plurality of apertures 36 formed longitudinally therein. Apertures 36 are dimensioned and arranged to accommodate the dielectric rods 32. Holder 34 is provided over rods 32 to maintain their orientations and spacings.

Slotted cylinder 12 is a regular hollow metallic right cylinder. This can be made from any highly conductive metal such as copper or the like in order to conduct electric current. The thickness of slotted cylinder is not critical; however, the length of the cylinder and the width of the slot relate to the design frequency of the antenna. Cylinder 12 is separated from ground plane 18 by an insulator 24 which can be an air gap or an insulating material. In a tested embodiment, slotted cylinder was 4 inches long with an outer diameter of 0.75 inches. The slot was 0.125 inches. Cylinder 12 was insulated from ground plane 18 using insulator 24 which was a 0.0625 inch layer of Rogers Duriod® which is a commercially available insulator.

In the embodiment shown, the dielectric rods 32 are arranged parallel to and equidistantly from slot 14 at a fixed radius. This radius should be approximately the same as the shortest operating wavelength of the antenna. Rods should be at least 10% longer than cylinder 12 and slot 14 in order to influence the electromagnetic radiation extending from cylinder 12. All of the rods 32 have an identical length. Rods 32 are made from a material with a high dielectric constant relative to free space. Testing found that a dielectric constant of approximately 30 was acceptable. Dielectric materials with a lower dielectric constant are unacceptable because the high impedance of the specified rods provides a contrast with the impedance of the surrounding space. Since impedance varies as the square root of the reciprocal of dielectric constant, the rods must have a fairly high dielectric constant of around 30 to get a proper contrast in impedances of greater than 5:1. The rods must also be long in comparison to their mean diameter. In the preferred case, the rods are at least 25 times longer than their diameter. The plurality of rods 32 can be rods having a circular cross-section. Rods 32 having other cross-sections are possible. In these embodiments the length and the mean diameter of the cross-section is used to give the proper aspect ratio. In a tested embodiment, rods 32 were 7 inches long and had a diameter of 0.25 inches. Rods 32 were made from a barium-titanate and epoxy resin material.

Cylindrical rod holder 34 must be made from a material having a dielectric constant lower than that of rods 32 by a factor of at least 1:10 in order to preserve the contrast between rods 32 and surrounding space. In the tested embodiment, rod holder 34 was made from polycarbonate and had a dielectric constant of approximately 2.4. Holder 34 was 7 inches tall with a 3.5 inch outer diameter and a 2.5 inch inner diameter. 0.25 inch longitudinal channels were drilled in holder 34 to accommodate rods 32.

Figure 1:
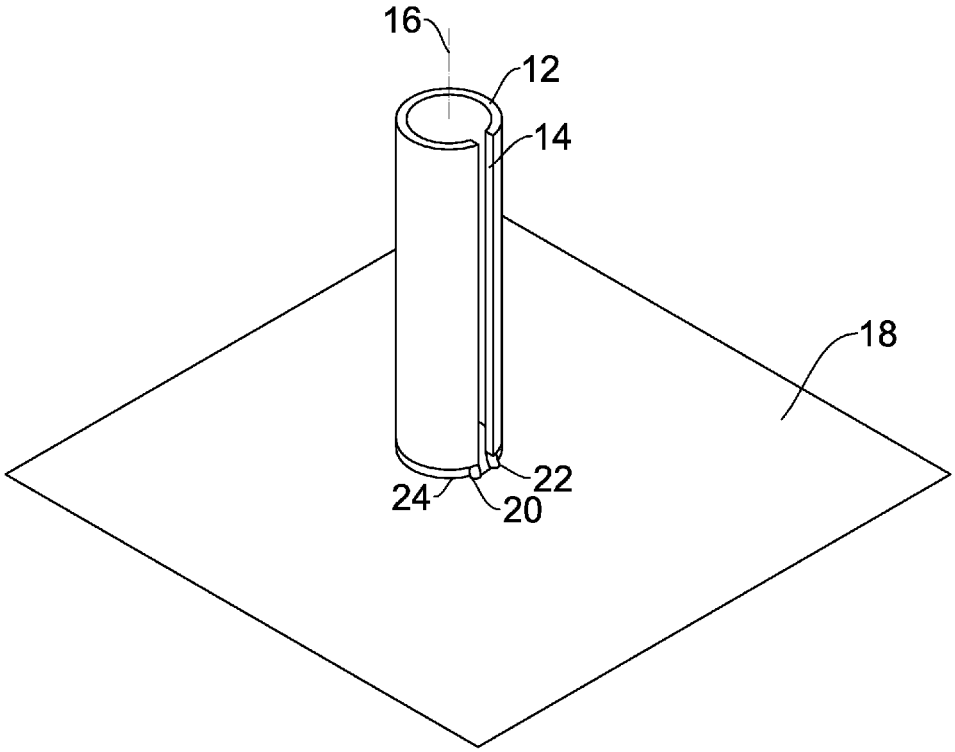
FIG. 1 (PRIOR ART)
FIG. 1 is a perspective view of a prior art antenna.
Figure 2:
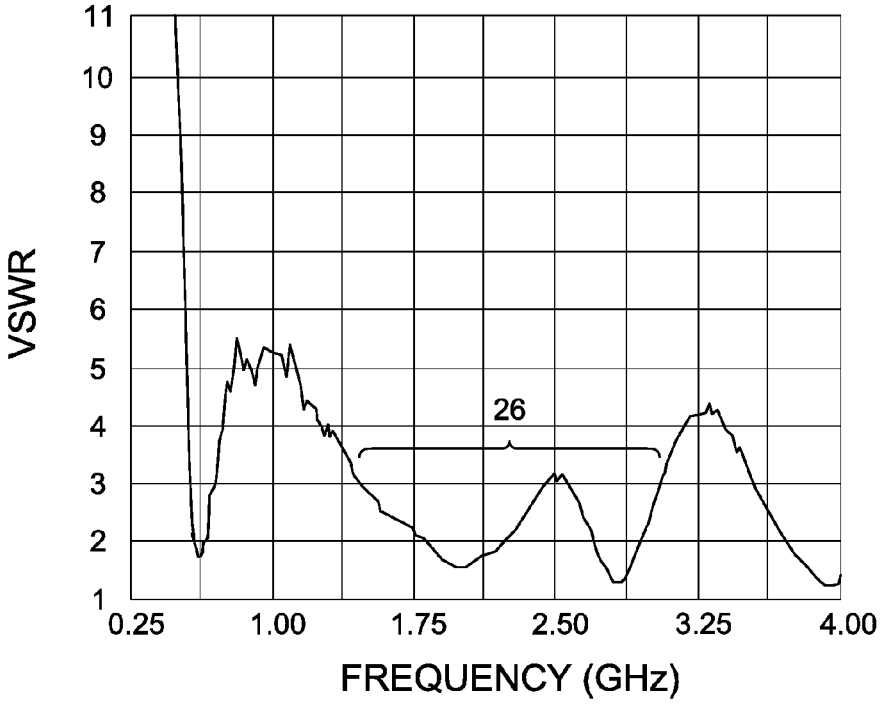
FIG. 2 is a graph of VSWR versus frequency for the prior art slotted antenna of FIG. 1.
Figure 4:
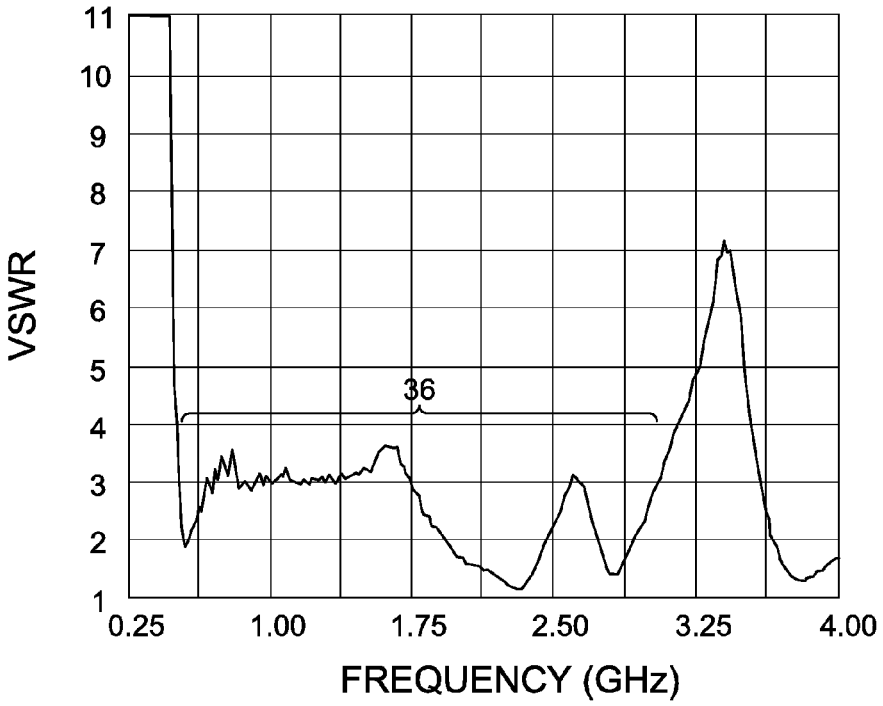
FIG. 4 is a graph of VSWR versus frequency for the antenna shown in FIG. 3.

The tested VSWR of antenna 30 is shown in FIG. 4. As before, bandwidth is indicated as the region where VSWR is around 3:1. This region is indicated as 36. When compared with the prior art antenna of FIG. 1, the embodiment shown in FIG. 3 provides an increase in bandwidth 36 over that indicated in the prior art plot provided as FIG. 2.

Figure 5:
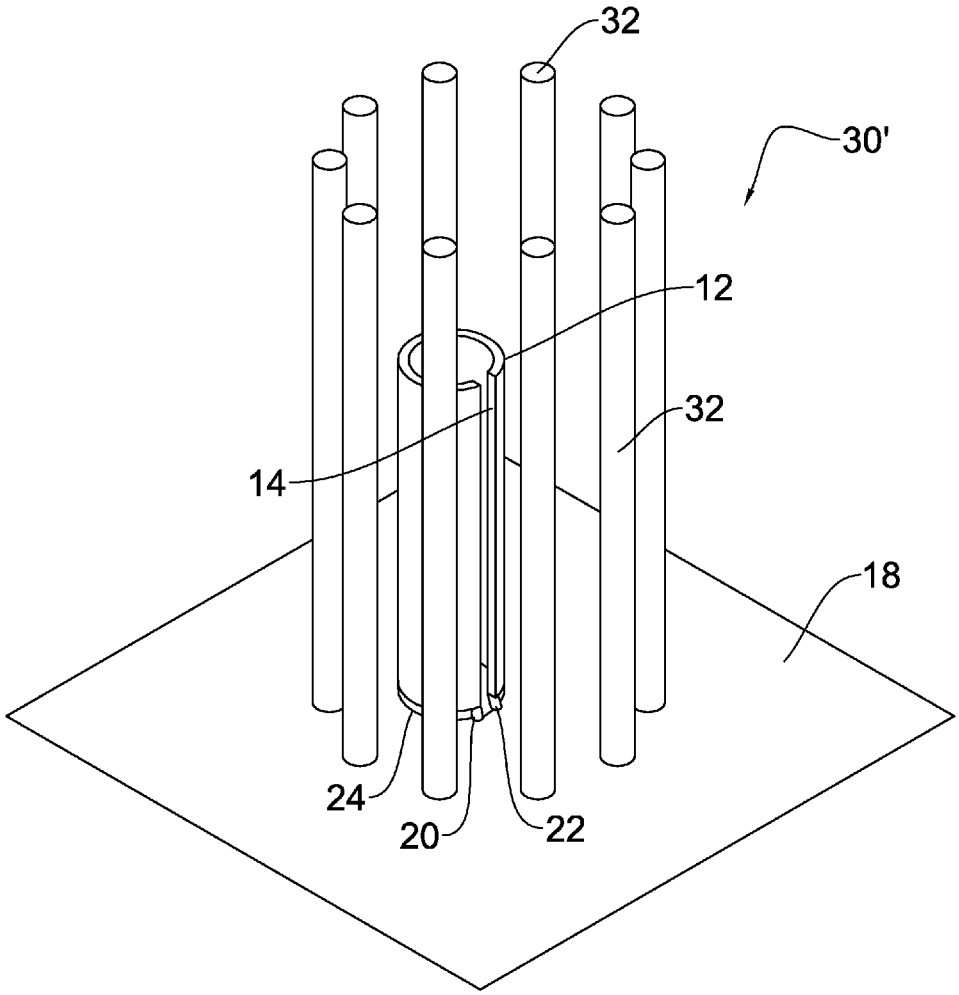
FIG. 5 is a perspective view of another embodiment of an antenna.

FIG. 5 shows an alternate embodiment 30' of the current antenna. This antenna 30' features slotted cylinder 12 having slot 14. As before, slotted cylinder 12 is fed by a two conductor feed including first conductor 20 and second conductor 22 positioned on either side of slot 14. Slotted cylinder 12 is insulated from ground plane 18 by insulating material 24. Dielectric rods 32 are positioned equidistantly from slot 14 and parallel to slot 14. Rods 32 are separated from one another by the same angle. Rods 32 extend perpendicular to ground plane 18. Antenna 30' of FIG. 5 differs from antenna 30 of FIG. 3 by omission of cylindrical rod holder 34. It is suggested that this configuration renders antenna 30' lighter while making it less durable.

Figure 6:
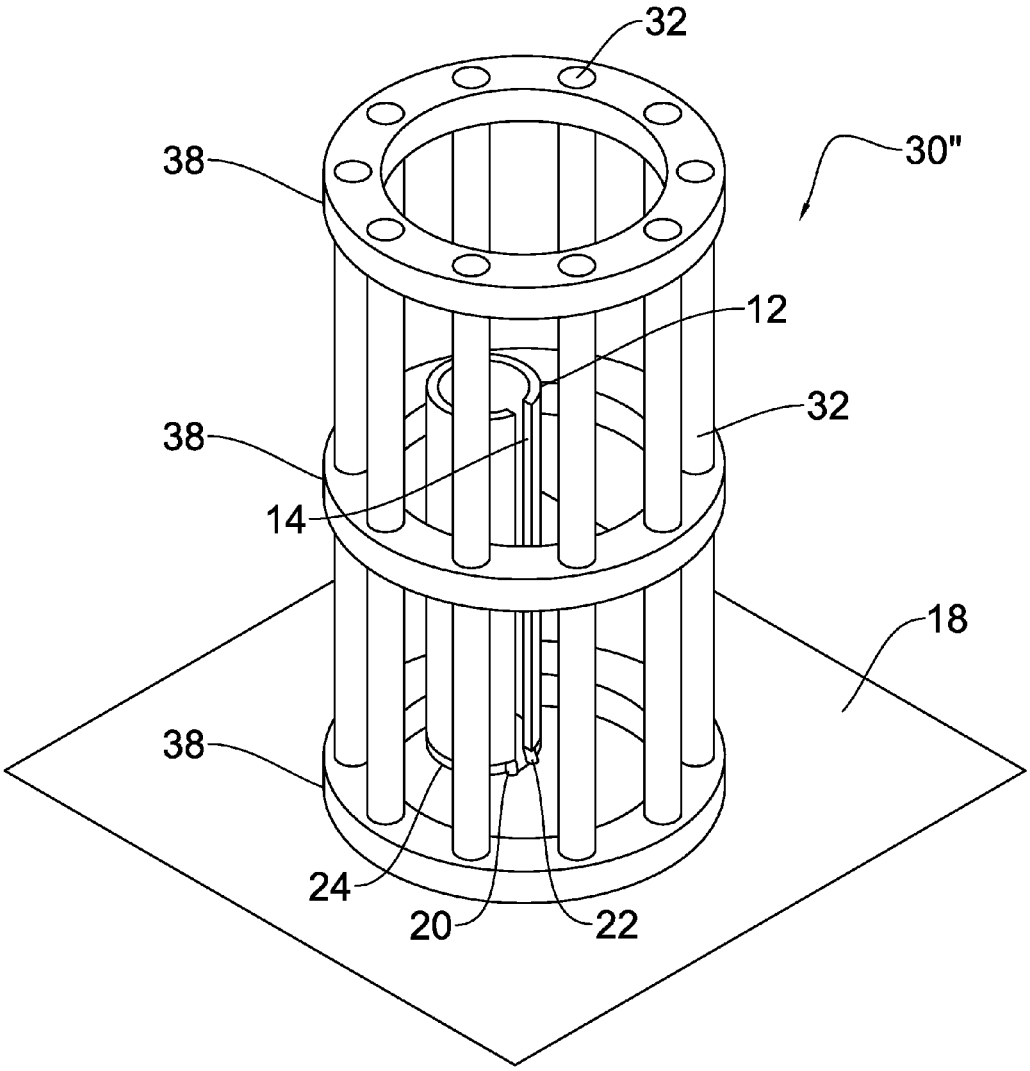
FIG. 6 is a perspective view of a third embodiment of the antenna.

FIG. 6 shows yet another alternate embodiment of the current antenna. In this embodiment, antenna 30" utilizes retaining brackets 38 in place of rod holder 34. Similar components of this antenna 30" are numbered as before. Retaining brackets 38 are positioned at various lengths along rods 32. Retaining brackets 38 are circular with apertures having a radius and spacing to accommodate rods 32. The number and positioning of brackets 38 is dictated by the need for structural support of rods 32. Brackets 38 can be fixed to rods by means known in the art. Brackets can be made from any material having a dielectric constant near that of the operating environment so as to avoid influencing the antenna.

Figure 7:
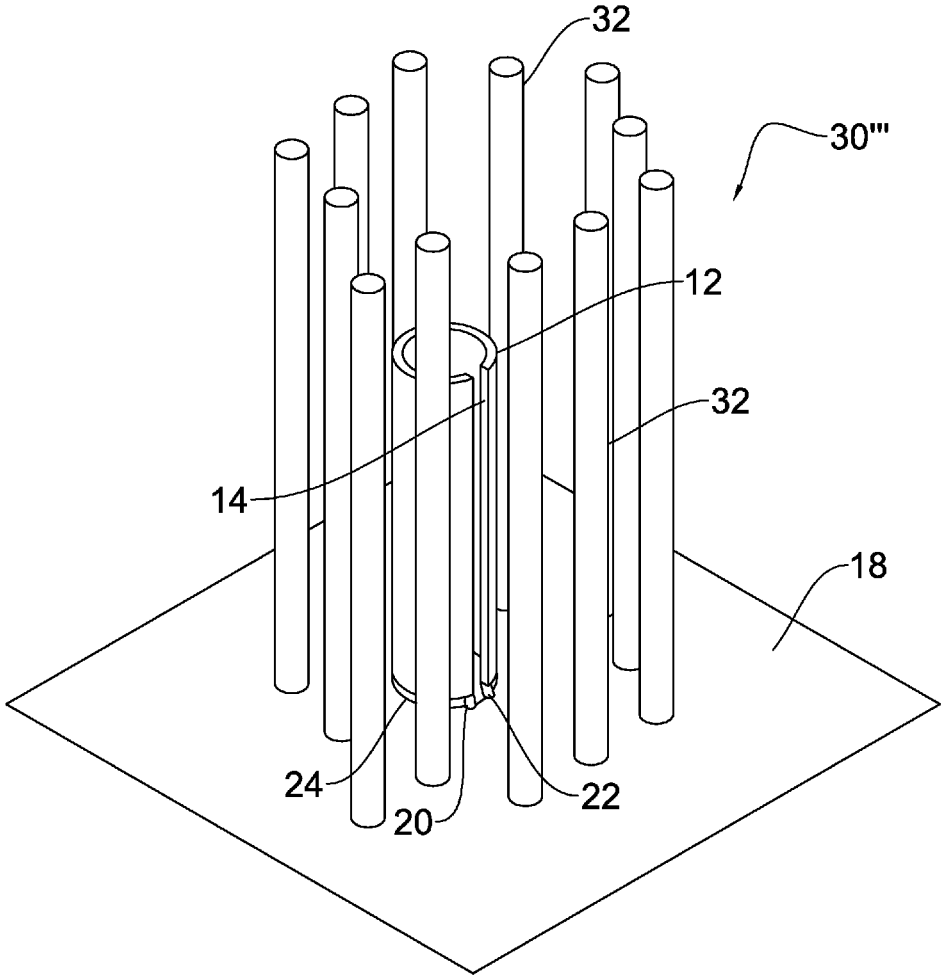
FIG. 7 is a perspective view of a fourth embodiment of the antenna.

FIG. 7 shows another embodiment of antenna 30'" that utilizes arbitrary positioning of rods 32 about cylinder 12 and slot 14. Rods 32 are generally spaced apart by between 1 and 5% of the wavelength of the highest operating frequency. Rod spacing should not be limited to circular and regular positioning.

It will be understood that many additional changes in the details, materials, steps and arrangement of parts, which have been herein described and illustrated in order to explain the nature of the invention, may be made by those skilled in the art within the principle and scope of the invention as expressed in the appended claims. For example, specific measurements are provided for components of the antenna; however, these measurements can be scaled to give different pass bands making the antenna applicable to operating frequencies other than those disclosed. Furthermore, the rods and retaining cylinder or brackets can be formed by other means known in the art such as by additive manufacturing.

The foregoing description of the preferred embodiments of the invention has been presented for purposes of illustration and description only. It is not intended to be exhaustive, nor to limit the invention to the precise form disclosed;

and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed and being positioned perpendicular to a ground plane comprising:

a conductive cylinder being substantially tubular and having a slot formed therein from a first end of the conductive cylinder to a second end of the conductive cylinder parallel to an axis of the conductive cylinder, the antenna feed being connectable to the conductive cylinder adjacent to and across the slot; and a plurality of dielectric rods parallel to the slot in said conductive cylinder, each said rod being positioned much less than one wavelength of the maximum operating frequency away from adjacent rods, each said rod having a length of at least 25 times its mean diameter and each rod being made from a material having a dielectric constant greater than 30.

2. The apparatus of claim 1 further comprising a hollow, cylindrical rod holder having a plurality of apertures formed longitudinally therein capable of accommodating said plurality of dielectric rods, said rod holder being positioned with one rod in each aperture such that said conductive cylinder is positioned in the hollow defined by said rod holder.

3. The apparatus of claim 2 wherein said rod holder has a dielectric constant of about 1:10 of that of said dielectric rods.

4. The apparatus of claim 2 wherein:

said dielectric rods are made from a barium-titanate and epoxy material; and said rod holder is made from a polycarbonate material.

5. The apparatus of claim 1 further comprising at least one circular rod retaining bracket having a plurality of apertures formed longitudinally therethrough capable of accommodating said plurality of dielectric rods, said at least one rod retaining bracket being positioned along the length of said dielectric rods with one rod in each aperture for retaining said plurality of rods in position with respect to one another and said conductive cylinder.

6. The apparatus of claim 1 wherein said dielectric rods extend at least 10% of the length of the conductive cylinder beyond the conductive cylinder on the end of the cylinder away from the ground plane.

7. The apparatus of claim 1 wherein the antenna is designed to operate at a range of frequencies, and each rod of said plurality of dielectric rods is positioned apart from the other rods at a distance of at least 5% of the wavelength of the lowest design frequency.

8. The apparatus of claim 7 wherein said plurality of dielectric rods are positioned in a circular array centered about the slot of the conductive cylinder.

9. The apparatus of claim 1 wherein said dielectric rods are made from a barium-titanate and epoxy resin material.

10. The apparatus of claim 1 further comprising a layer of electrically insulating material positioned between said conductive cylinder and the ground plane.

11. The apparatus of claim 10 wherein said layer of electrically insulating material is air.

12. A kit for modifying a slotted cylinder antenna positioned vertically above a ground plane comprising a plurality of dielectric rods parallel to the slot in said slotted cylinder antenna, each said rod being positioned much less than one wavelength of the maximum operating frequency of the slotted cylinder antenna away from adjacent rods, each said rod having a length of at least 25 times its mean diameter and each rod being made from a material having a dielectric constant greater than 30.

13. The apparatus of claim 12 further comprising a hollow, cylindrical rod holder having a plurality of apertures formed longitudinally therein capable of accommodating said plurality of dielectric rods, said rod holder being positioned with one rod in each aperture such that the slotted cylinder antenna is positioned in the hollow defined by said rod holder.

14. The apparatus of claim 12 further comprising at least one circular rod retaining bracket having a plurality of apertures formed longitudinally therethrough capable of accommodating said plurality of dielectric rods, said at least one rod retaining bracket being positioned along the length of said dielectric rods with one rod in each aperture for retaining said plurality of rods in position with respect to one another and the slotted cylinder antenna.

15. The apparatus of claim 12 wherein said dielectric rods extend at least 10% of the length of the slotted cylinder antenna beyond the slotted cylinder antenna on the end of the slotted cylinder antenna away from the ground plane.

16. The apparatus of claim 12 wherein the slotted cylinder antenna is designed to operate at a range of frequencies, and each rod of said plurality of dielectric rods is positioned apart from the other rods at a distance of at least 5% of the wavelength of the lowest design frequency.

* * * * *